United States Patent [19]

Maier

[11] Patent Number: 4,572,475

[45] Date of Patent: Feb. 25, 1986

[54] FORM FOR POURING OF CONCRETE OR THE LIKE

[76] Inventor: Josef Maier, Schwimmbadstrasse 3, D-7611 Steinach, Fed. Rep. of Germany

[21] Appl. No.: 691,903

[22] Filed: Jan. 16, 1985

[30] Foreign Application Priority Data

Jan. 31, 1984 [DE] Fed. Rep. of Germany ..... 3403148

[51] Int. Cl.[4] ..... E04G 11/00; B28B 7/30

[52] U.S. Cl. ..... 249/194; 249/27

[58] Field of Search ..... 249/26, 27, 194

[56] References Cited

U.S. PATENT DOCUMENTS

| | | | |
|---|---|---|---|
| 1,212,499 | 1/1917 | Kemon | 249/194 X |
| 1,271,262 | 7/1918 | Bachman | 249/27 |
| 1,538,496 | 5/1925 | Wells | 249/194 X |
| 1,619,321 | 3/1927 | Troiel | 249/27 X |
| 1,694,292 | 12/1928 | Tracey | 249/27 |
| 1,696,700 | 12/1928 | Suiter | 249/194 X |
| 1,780,661 | 11/1930 | Wedberg | 249/194 X |
| 2,763,048 | 9/1956 | Sullivan | 249/194 X |
| 2,789,337 | 4/1957 | Arrighini et al. | 249/194 |
| 2,794,235 | 6/1957 | Hillberg | 249/194 |
| 2,826,801 | 3/1958 | Imonetti et al. | 249/194 X |
| 3,077,653 | 2/1963 | Ward | 249/194 X |
| 3,166,818 | 1/1965 | Sakai et al. | 249/194 |

FOREIGN PATENT DOCUMENTS

| | | |
|---|---|---|
| 2119362 | 11/1972 | Fed. Rep. of Germany . |
| 7308620 | 6/1973 | Fed. Rep. of Germany . |

*Primary Examiner*—J. Howard Flint, Jr.
*Attorney, Agent, or Firm*—Peter K. Kontler

[57] ABSTRACT

A box-shaped hollow form section which is used as a component of a concrete pouring form has two mutually inclined abutting upright panels and two end panels at the upper and lower ends of the upright panels to define therewith an elongated chamber affording access to the ends of conventional panels which can be connected to coupling members or boards bounding portions of the chamber and extending from the inner sides of the upright panels. The coupling members or boards have elongated slots to afford access to the ends of conventional panels, and such coupling members or boards define an elongated inlet which affords access to the chamber. The form section can be installed in the region which is to constitute the corner between two concrete sidewalls and a ceiling.

18 Claims, 2 Drawing Figures

FORM FOR POURING OF CONCRETE OR THE LIKE

BACKGROUND OF THE INVENTION

The present invention relates to forms or molds of the type suitable for the pouring of concrete or other building materials. More particularly, the invention relates to improvements in certain portions or sections of forms or molds, namely to improvements in those sections which can constitute the means for joining two or more panels preparatory to the pouring of mutually inclined walls, such as two upright walls which define an upright corner.

It is already known to define the corner between two upright concrete walls by two mutually inclined panels which are connectable with additional panels to constitute therewith the inner part of a complete form defining a cavity for the pouring of concrete. Reference may be had to commonly owned German Auslegeschrift No. 21 19 362 which discloses and shows several hollow form sections each having a substantially L-shaped cross-sectional outline. The outer side of each form section is to be contacted by the building material and the side faces of each section can be provided with means for coupling it to additional panels whose outer sides are to be contacted by the building material. The form sections which are disclosed in this German publication are quite satisfactory for the formation of the corner between two mutually inclined walls consisting of concrete or the like. Such form sections can be joined end-to-end to ensure that they can be used in forms or molds for the pouring of tall or relatively low walls and, for this purpose, their ends are equipped with complementary fastening devices in the form of pins and sockets or the like. However, the just described form sections are not suitable for the erection of three mutually inclined walls such as two upright walls which define a vertical corner and a ceiling which overlies the upper end of the corner. It is then necessary to provide a specially designed extra panel which is assembled with an L-shaped frame section of the type disclosed in the German publication so as to close the space between the upper ends of the component parts of the L-shaped section. Moreover, the L-shaped sections must be reinforced by rather complex stiffening devices in order to ensure that they can withstand the stresses which develop when the form is in actual use, i.e., when the outer sides of the panels forming part of the L-shaped sections are contacted by concrete or another building material.

German Utility Model No. 73 08 620 discloses an apparatus which constitutes a form for the pouring of U-shaped concrete structures of desired size, especially of structures which can be used as parts of light conducting ducts and can be produced at the site of erection of a building or the like. The apparatus employs two U-shaped components of variable length and/or height. The inner and outer sides of the two components can be lined with panels which come into direct contact with poured concrete. This apparatus is not suited for the pouring of three mutually inclined concrete walls or the like but only for the pouring of material which is to form two parallel walls and a third wall connecting the two parallel walls to one another.

OBJECTS AND SUMMARY OF THE INVENTION

An object of the invention is to provide a novel and improved section which can be used in the corner region of a form for the pouring of concrete and which can constitute the junction between two or more larger panels of the type normally used to define a cavity for the pouring of concrete or another building material.

Another object of the invention is to provide a form section which can be used in the region where two upright walls and the ceiling and/or floor of a concrete structure meet and which can be readily attached to or disconnected from additional panels.

A further object of the invention is to provide a simple and inexpensive but highly versatile form section which can be used with existing panels of a concrete form or the like.

An additional object of the invention is to provide a form section which can be reinforced in a simple and efficient way to stand the stresses which develop during pouring and/or during setting of concrete or another hardenable building material.

Still another object of the invention is to provide a form section which can be built from simple and readily available components and which can be assembled with additional parts of a concrete form or the like by semi-skilled or even unskilled persons.

The invention is embodied in a form section for lining the space between three mutually inclined walls, particularly between two girders which define an upright corner and a ceiling overlying the corner. Such girders and ceiling can be made of concrete which is poured into the space adjacent to the outer sides of the form section. The improved form section comprises first and second panels which define an elongated corner with a first end and a second end, and a third panel which overlies one end of the corner between the first and second panels. At least two but preferably all three panels are preferably disposed in planes which make angles of 90 degrees with each other. A fourth panel can be provided to overlie the other end of the corner between the first and second panels. The outer sides of the panels can be contacted by concrete or another building material which is poured into the cavity around the form section to form the aforementioned walls.

The form section preferably further comprises coupling means for facilitating connection of at least one of the first and second panels with an additional panel, preferably in such a way that one side of the latter is at least substantially coplanar with the outer side of the respective panel. As a rule, the coupling means will include two boards, one for each of the first and second panels, which extend at right angles to the inner sides of the respective (first and second) panels and are provided with elongated openings in the form of slots extending in the longitudinal direction of the corner between the first and second panels, preferably the full length of the boards. Such slots can receive portions of or afford access to the respective additional panels. The length of the boards preferably equals or approximates the length of the respective panels, as considered in the longitudinal direction of the corner between the first and second panels, and the boards are preferably normal or substantially normal to the respective panels.

The first and second panels are preferably provided with coplanar end faces which abut against the inner sides of the third and fourth panels, and the third and fourth panels have edge faces which are preferably flush with the outer sides of the first and second panels. The boards and the four panels define an elongated chamber of preferably square cross-sectional outline and the boards preferably define an elongated inlet which is located opposite the corner between the first and second panels and affords access to the chamber. Each of the third and fourth panels can have a polygonal (preferably rectangular or square) outline.

The boards and/or the panels are preferably made of a metallic material, such as sheet steel. The chamber can receive reinforcing means in the form of one or more plates, brackets, beams, bars or the like, preferably at least one reinforcing member which extends transversely of the corner between and is secured to the first and second panels and/or to the boards to stiffen the form section and enable its panels to stand the stresses which arise when the outer sides of such panels are in contact with poured concrete or other building material.

The novel features which are considered as characteristic of the invention are set forth in particular in the appended claims. The improved form section itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
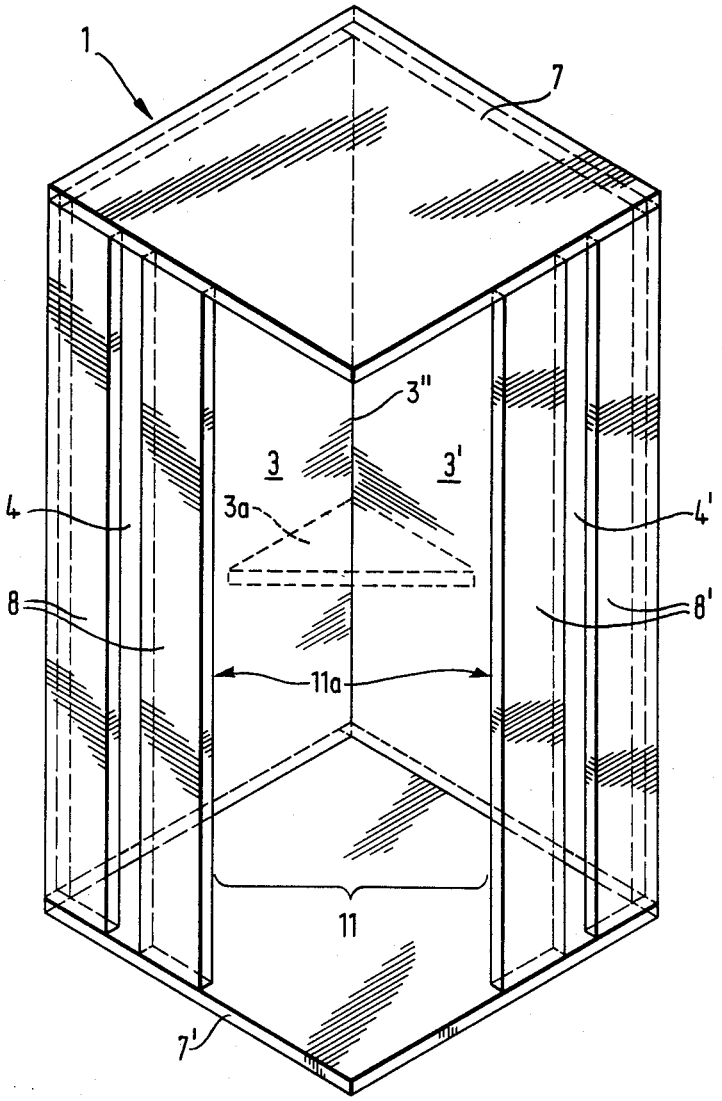
FIG. 1 is a schematic perspective view of a form section which embodies one form of the invention and has two square panels overlying the ends of the corner which is defined by the first and second panels.

Referring first to FIG. 1, there is shown a form section 1 which embodies the present invention and includes a first upright panel 3, a second upright panel 3' which makes with the first panel an angle of 90 degrees, a third panel 7 which makes an angle of 90 degrees with each of the panels 3, 3', and a fourth panel 7' which makes an angle of 90 degrees with each of the panels 3, 3' and is parallel to the panel 7. The outer sides of the panels 3, 3' and 7 or 3, 3' and 7' are contacted by poured concrete or another building material when the form section 1 is put to use in a manner as shown, for example, in FIG. 2. The inner sides of the panels 3, 3', 7 and 7' bound an elongated chamber 11 which is accessible through an elongated inlet 11' between the adjacent vertical edge faces of two elongated substantially plate-like coupling members or boards 8, 8' constituting a coupling means for facilitating attachment of the panels 3 and 3' to additional panels. For this purpose, the coupling members or boards 8 and 8' are formed with elongated openings in the form of slots 4, 4' extending in parallelism with the elongated corner 3'' between the inner sides of the panels 3 and 3'. The inlet 11' is also parallel to the corner 3'. The upper end of this corner is overlapped by the panel 7 and its lower end is overlapped by the panel 7'. The coplanar upper edge faces of the panels 3, 3' and coupling members or boards 8, 8' but against the underside or inner side of the upper panel 7, and the coplanar lower edge faces of the panels 3, 3' and coupling members or boards 8, 8' abut against the upper side (inner side) of the lower panel 7'. The edge faces of the panels 7 and 7' are flush with the outer sides of the panels 3, 3' and boards 8, 8'. The manner in which the panels 3, 3' are preferably separably connected with the panels 7, 7' and the manner in which the panels 3, 3' and boards 8, 8' are preferably separably connected with the panels 7, 7' is not specifically shown in the drawing; the connecting means can include nails, screws, bolts and nuts and/or other types of fasteners, depending on the material of the panels and boards. It is presently preferred to make the panels and/or the boards of a suitable metallic material, particularly sheet steel.

In the embodiment which is shown in FIG. 1, the chamber 11 has a substantially square cross-sectional outline and each of the panels 7, 7' is also a square. However, it is also possible to employ top and bottom panels having another polygonal outline, e.g., rectangular top and bottom panels, without departing from the spirit of the invention.

FIG. 1 further shows, by broken lines, that the form section 1 can be provided with reinforcing means for the panels and boards, e.g., with at least one reinforcing member 3*a* which extends transversely across at least a portion of the chamber 11 and is separably or permanently affixed to the inner sides of the panels 3 and 3'. This reinforcing member can also be affixed to the boards 8, 8', only to the boards or to one of the panels 3, 3' and one of the boards 8', 8. Furthermore, the reinforcing means can comprise two or more reinforcing members in the form of beams, plates, brackets or the like, as long as such members can stiffen and strengthen the form section 1 so that the latter can readily withstand stresses which develop during pouring and/or during setting of concrete in a cavity a portion of which is bounded by the outer sides of the panels 3, 3' and 7 or 3, 3' and 7'.

Figure 2:
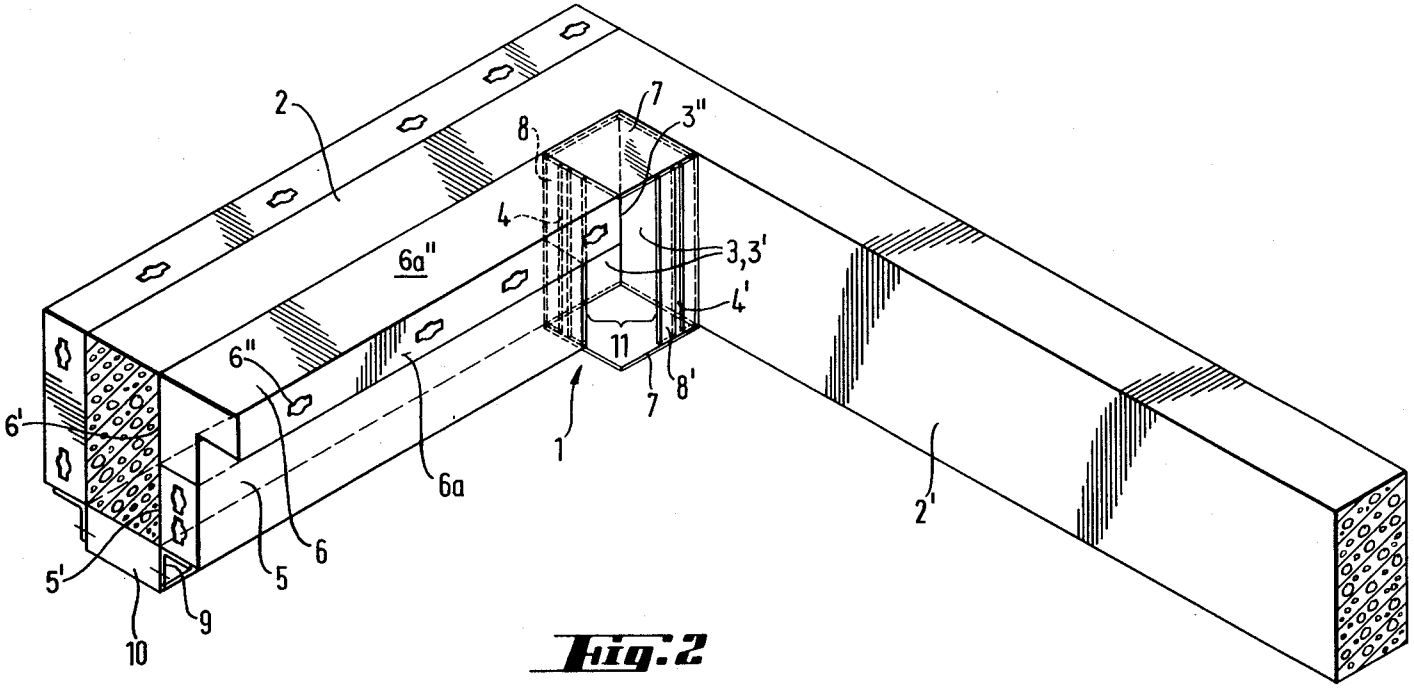
FIG. 2 is a smaller-scale perspective view of the form section which is installed between two of three walls consisting of concrete or the like, and further showing two additional panels which are separably coupled to the first panel.

FIG. 2 shows a form section 1 in place between two upright walls 2, 2' of poured concrete or the like. A third wall (such as a concrete ceiling) above the upper side of the top panel or third panel 7 has been omitted in FIG. 2 for the sake of clarity. It will be noted that the outer sides of the panels 3 and 3' are respectively in contact with the adjacent sides of the walls 2, 2' in the region where such walls form an upright corner outwardly adjacent to the corner 3'' between the inner sides of the panels 3 and 3'.

FIG. 2 further shows the manner in which the board 8 facilitates the coupling of two additional panels 5 and 6 to the section 1, and more particularly to the panel 3 in such a way that the outer sides 5', 6' of the additional panels 5, 6 are coplanar with the outer side of the panel 3 and are thus in contact with the major portion of the wall 2. The bottom panel 7' rests on the floor or on a suitable support. The panel 7 or 7' is optional because the reinforcing means in the chamber 11 of the section 1 can readily ensure that the panels 3, 3' and 7 or 3, 3' and 7' remain in optimum positions with reference to each other while the form including the section 1 is in actual use for the pouring of concrete or while the concrete forming the walls 2, 2' and the non-illustrated ceiling is in the process of setting. Nevertheless, it is normally preferred to employ two end panels 7 and 7' because they enhance the stability of the section 1 and also because this section can be used in the orientation as shown in FIGS. 1 and 2 or turned upside down so that the panel 7 takes the place of the panel 7' and vice versa.

The additional panels 5 and 6 are or can be hollow, and the upper side 6a'' of the upper part 6a of the generally L-shaped additional panel 6 is in contact with the underside of the aforementioned ceiling. The character 6'' denotes one of the fastening means which can be used to attach the upper part 6a of the panel 6 to a further panel or to several further panels whose upper sides contact the underside of the ceiling. The board 8' can be used to couple the respective panel 3' with a second set of additional panels, e.g., with two panels which are identical with or similar to the panels 5 and 6.

The openings 4 and 4' preferably extend all the way or nearly all the way between the panels 7 and 7' in order to ensure that the additonal panel 5 and/or 6 can be mounted at any desired level therebetween. This contributes to versatility of the improved form section because a panel 6 can be caused to abut against the underside of a ceiling which is flush with the upper side of the panel 7 or with the underside of a ceiling which extends to a level below the upper side of the panel 7.

FIG. 2 further shows a bracket 9 forming part of a securing means which serves to connect the panel 5 with a further panel 10 bounding a portion of the space which receives the material of the wall 2, i.e., the panel 10 abuts against the underside of the wall 2 when the latter is finished. It will be noted that the form section 1 and the additional panels 5, 6 or analogous additional panels allow for the assembly of a composite form wherein the panels are disposed at different levels and extend in different directions at right or other angles relative to each other so that they intersect or bypass one another. The additional panels may be of conventional design so that such available panels can be assembled directly with one another (as shown in FIG. 2 for the panels 5 and 10) or through the medium of the improved form section 1. The dismantling of a composite form which includes the section 1 is just as simple and consumes very little time.

It is equally possible to assemble the panels 3, 3' and boards 8, 8' with the panels 7, 7' in such a way that the panels 7 and 7' extend into the spaces defined by the adjacent end portions of the parts 3, 3', 8 and 8'. Each of the two possibilities (i.e., the just mentioned one and that which is actually shown in FIG. 1) ensures that the form section 1 remains stable and can readily stand the stresses which arise in actual use, i.e., during and subsequent to pouring of concrete or another building material. The illustrated boxshaped section 1 has been found to be capable of standing pronounced stresses without any or without appreciable deformation, even in the absence of reinforcing means in the chamber 11.

The inlet 11a is sufficiently wide to afford convenient access to the chamber 11. This renders it possible to apply or to remove bolts, screws and/or other types of fasteners serving to connect the boards 8, 8' with additional panels, such as the panels 5 and 6 of FIG. 2. The provision of a chamber 11 which is readily accessible contributes significantly to convenience of assembling the improved form section 1 with one or more additional panels. A chamber having a square cross-sectional outline is preferred at this time because the form section defining such chamber can be readily fitted into the corner between any three walls in any one of a number of different orientations.

As mentioned above, the panels 3, 3', 7, 7' and the coupling members or boards 8, 8' are preferably made of a suitable metallic material, especially sheet steel. The provision of reinforcing means in the chamber 11 is advisable and advantageous when the form section 1 is relatively long or very long so that internal propping enables the panels and boards of the form section to stand pronounced deforming stresses. As mentioned above, a single reinforcing member will suffice in many instances but it is evidently within the purview of the invention to employ two or more reinforcing members which extend in parallelism with or transversely of the corner 3'' and/or in any other desirable orientation. Plate-like reinforcing members have been found to contribute significantly to rigidity of the improved form section.

An important advantage of the improved form section is that it can be used in conjunction with a wide variety of conventional panels and that its manufacture involves a relatively low cost. Moreover, the form section can be used in the illustrated or inverted position and can be reinforced to the extent and in a manner as is necessary to ensure adequate rigidity in actual use.

Another important advantage of the improved form section is that it can be assembled with additional panels in such a way that the additional panels or portions thereof constitute extensions of the panel 7 or 7', i.e., a panel which is not provided in heretofore known forms for the pouring of concrete or the like. The panel 7 or 7' constitutes a transition between the neighboring panels which are adjacent to the underside of the ceiling. The panel 7 or 7' can be connected with additional panels which are adjacent to the underside of the ceiling by connecting means of the type disclosed in the aforementioned German Auslegeschrift No. 21 19 362 which, however, does not disclose any equivalents of the panel 7 or 7'.

The exact manner in which the improved form section can be connected with one or more additional panels forms no part of the invention. The fastening means can be similar or identical with those which are used in conventional forms to thus ensure that one can assemble the improved form section with conventional panels to constitute therewith a complete form for the pouring of three walls including two first walls defining an elongated corner and a third wall which overlies the one or the other end of the corner between the two first walls. The end portions of the panels 5, 6 can be provided with keyhole-shaped or otherwise configurated slots for reception of bolts with transverse pins or analogous fasteners which are inserted from the chamber 11.

Several form sections of the type shown in FIGS. 1 and 2 can be assembled with additional panels, e.g., to allow for simultaneous pouring of four upright walls and a ceiling. The attachment of additional panels (such as 5, 6) to the improved form section does not interfere with attachment of such additional panels to other panels (such as the panel 10) in a manner which is known from the art.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A form section for insertion into the space between three mutually inclined walls, particularly between two girders which define an upright corner and a ceiling overlying the corner, comprising first and second panels defining an elongated corner with a first end a second end; and a third panel overlying one end of the corner between the first and second panels and defining a chamber with said first and second panels; and coupling means for facilitating connection of said first and second panels to additional panels, said coupling means including first and second substantially plate-like coupling members extending along said first and second panels and to said third panel and defining an inlet which afford access to said chamber.

2. The form section of claim 1, wherein said first and second panels have at least substantially coplanar end faces in the region of the one end of the corner between said first and second panels.

3. The form section of claim 1, wherein at least two of said panels are disposed in planes making an angle of substantially 90 degrees.

4. The form section of claim 1, wherein said first and second panels make an angle of 90 degrees and said third panel makes an angle of 90 degrees with each of said first and second panels.

5. The form section of claim 1, further comprising a fourth panel overlying the other end of the corner between the first and second panels.

6. The form section of claim 1, wherein each of said first and second panels has an inner side and an outer side and said coupling members extend from the inner sides of the respective panels and define openings extending longitudinally of the corner between said first and second panels.

7. Th form section of claim 6, wherein the length of said coupling members at least approximates the length of the respective panels, as considered in the longitudinal direction of the corner between said first and second panels, and the length of said openings at least approximates the length of the respective coupling members.

8. The form section of claim 6, wherein said coupling members are at least substantially normal to the respective panels.

9. The form section of claim 1, wherein said third panel is a four-sided polygon, suoh as a square or a rectangle.

10. The form section of claim 1, wherein each of said panels has an inner side and an outer side, said first and second panels having end faces abutting the inner side of said third panel and said third panel having edge faces flush with the outer sides of said first and second panels.

11. The form section of claim 10, wherein said panels have inner sides and outer sides and the inner sides of said panels are adjacent to said chamber, said coupling members extending from and being inclined with reference to the inner sides of the respective panels and said inlet being located opposite the corner between said first and second panels.

12. The form section of claim 10, wherein said chamber has a square cross-sectional outline.

13. The form section of claim 1, wherein said third panel has a square outline.

14. The form section of claim 1, wherein said panels consist of a metallic material, such as sheet steel.

15. The form section of claim 14, further comprising coupling means for facilitating connection of said first and second panels to additional panels, said coupling means including coupling members consisting of a metallic material, such as sheet steel.

16. The form section of claim 1, further comprising coupling means for facilitating connection of said first and second panels to additional panels, said coupling means including coupling members defining with said first, second and third panels said chamber which is elongated, and further comprising reinforcing means provided in said chamber to maintain the first, second and third panels in predetermined positions with reference to each other.

17. The form section of claim 16, wherein said reinforcing means comprises at least one reinforcing member extending transversely of said corner and affixed to said first and second panels.

18. The form section of claim 1, wherein said panels have outer sides bounding a portion of a cavity for the pouring of concrete or another building material.

* * * * *